US005142822A

United States Patent [19]

Beckerman

[11] Patent Number: 5,142,822

[45] Date of Patent: Sep. 1, 1992

[54] SAFETY ARRANGEMENT FOR AUTOMATIC DOOR OPERATOR

[75] Inventor: Howard L. Beckerman, Middletown, N.J.

[73] Assignee: Atlas Roll-Lite Door Corporation, Edison, N.J.

[21] Appl. No.: 750,185

[22] Filed: Aug. 26, 1991

[51] Int. Cl.[5] ..... E05F 15/02

[52] U.S. Cl. ..... 49/27; 49/28

[58] Field of Search ..... 49/27, 28; 200/61.43

[56] References Cited

U.S. PATENT DOCUMENTS

| | | | |
|---|---|---|---|
| 3,975,861 | 8/1976 | Baump et al. | 49/28 |
| 4,115,952 | 9/1978 | French | 49/26 |
| 4,335,339 | 6/1982 | Brickner | 318/282 |
| 4,369,344 | 1/1983 | Diamond | 200/61.43 |
| 4,943,757 | 7/1990 | Richter et al. | 49/28 X |
| 5,027,552 | 7/1991 | Miller et al. | 49/27 |

*Primary Examiner*—Philip C. Kannan

*Attorney, Agent, or Firm*—David L. Davis

[57] ABSTRACT

A safety arrangement for an automatic door operator wherein the door edge has mounted thereon a stretched electrically conductive cable which, when deflected upon encountering an obstruction, will change the inductance of a loop of which the cable forms a part. A capacitor is in parallel with this loop so that the capacitor together with the inductance of the loop form a resonant tank circuit. The tank circuit is electrically driven by a voltage controlled oscillator. The phase of the loop current is compared with the phase of the voltage across the capacitor and the phase difference is utilized to control the voltage controlled oscillator to maintain the tank circuit in resonance (i.e, zero phase difference). The detection of a sudden change in phase difference, which occurs when the loop inductance is suddenly changed due to the encountering of an obstruction by the door edge, results in the generation of an obstruction signal for activating the safety feature of the door operator.

13 Claims, 3 Drawing Sheets

SAFETY ARRANGEMENT FOR AUTOMATIC DOOR OPERATOR

BACKGROUND OF THE INVENTION

This invention relates to door operators and, more particularly, to a safety arrangement for such an operator which is sensitive to the door striking an obstruction while being closed.

The use of safety arrangements in conjunction with automatic door operators to prevent the door from continuing to close upon striking an obstruction is generally well known, particularly in the case of garage type doors which move along a track toward and away from a fixed surface. Some of the known arrangements sense the striking of an obstruction in an indirect manner such as, for example, by detecting a change in load on the motor driving the door. Other known arrangements use a more direct approach, such as, for example, by employing a light beam which extends along the door edge, the light beam being broken when the door edge encounters an obstruction. However, in a factory environment, such an arrangement has proven to be disadvantageous in that dirt and debris can interfere with the light beam. Another sensing arrangement which has been proposed includes a pair of conductors which are maintained in spaced apart parallel relationship relative to the door edge until an obstruction is encountered, at which time the conductors are moved into contact with each other. This arrangement also suffers from numerous disadvantages such as, for example, build up of debris and/or corrosion on the conductors which either causes the conductors to contact prematurely or prevents the conductors from making any contact. Also, immersion of the conductors in water can cause a false reading.

It is therefore a primary object of the present invention to provide a safety arrangement for a motor driven door which is sensitive to the door striking an obstruction during its travel.

It is another object of this invention to provide such a safety arrangement which does not suffer from any of the disadvantages enumerated above.

SUMMARY OF THE INVENTION

The foregoing, and additional, objects are attained in accordance with the principles of this invention by providing a safety arrangement for a motor driven door which includes a first electrically conductive member fixedly secured to the door edge and an elongated flexible second electrically conductive member connected at one end to the first conductive member and supported from that end to its other end spaced and insulated from the first conductive member. A capacitor is connected between that other end of the second conductive member and a point on the first conductive member remote from where the first and second conductive members are connected together, so as to form a loop. The capacitor together with the inductance of the loop form a resonant tank circuit. The tank circuit is maintained in resonance by a voltage controlled oscillator. The phase of the loop current is compared to the phase of the voltage across the capacitor and the phase difference is utilized to drive the voltage controlled oscillator to maintain the tank circuit in resonance (i.e., zero phase difference). When the loop inductance is suddenly changed due to the encountering of an obstruction by the door edge, the phase difference suddenly increases, allowing a safety signal to be generated for controlling the door operator.

In accordance with an aspect of this invention, the first conductive member includes a metal plate covering the door edge.

In accordance with another aspect of this invention, the second conductive member includes a metal wire.

In accordance with a further aspect of this invention, the metal wire is maintained under tension.

BRIEF DESCRIPTION OF THE DRAWING

The foregoing will be more readily apparent upon reading the following description in conjunction with the drawings in which like elements in different figures thereof are identified by the same reference numeral and wherein.

DETAILED DESCRIPTION

Figure 1:
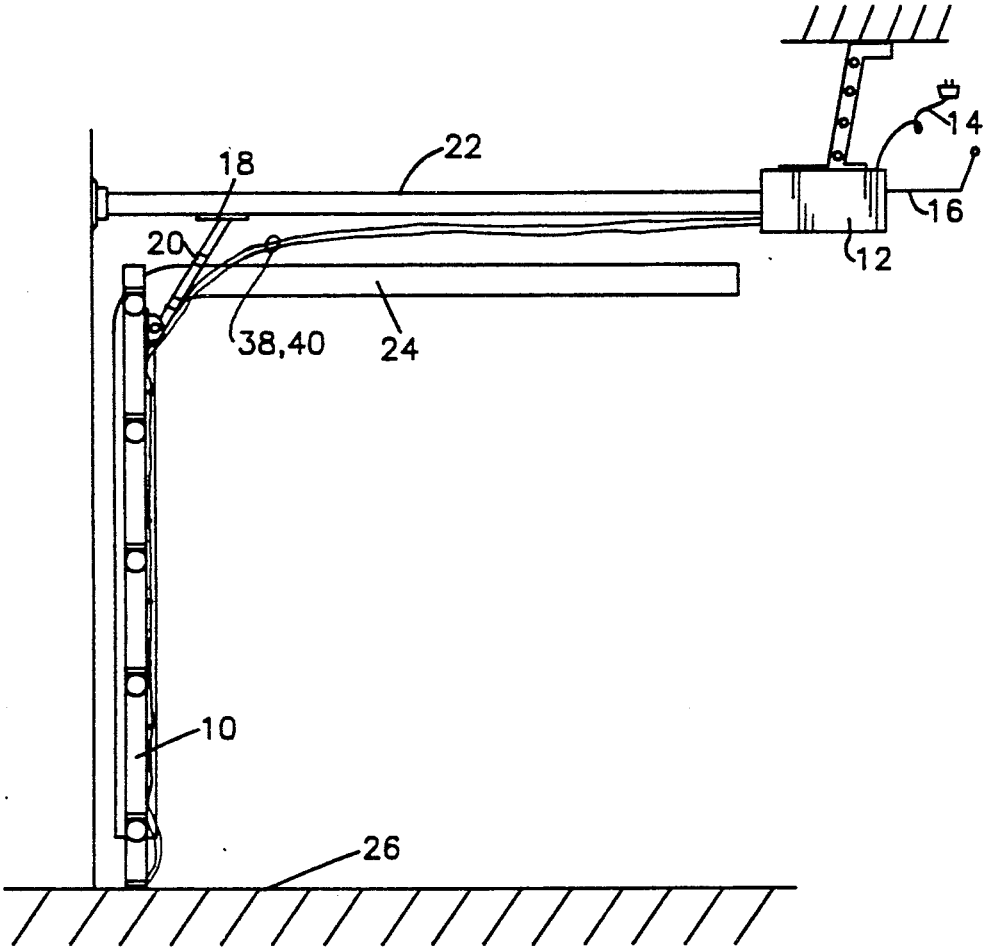
FIG. 1 is a side view of a motor driven garage door in which an arrangement constructed in accordance with the principles of this invention is incorporated.

Referring now to the drawings, FIG. 1 illustrates a garage door 10 driven by a door operator 12. As is conventional, the door operator 12 is connected to a source of commercially available power via the line cord 14 and optionally may include an antenna 16 by means of which it can receive radio frequency control signals. The door operator 12 includes a motor (not shown) for moving the carriage 18, connected to the door 10 via the linkage 20, along the track 22. The door 10 is thusly moved along a path defined by the track 24 toward and away from the fixed surface 26, i.e., the garage floor.

As is known, the door 10 is subject to encountering obstructions as it is moved toward its closed position where its bottom edge is in close proximity to the floor 26. It is common to provide an arrangement for sensing the encountering of an obstruction and causing the operator 12 to reverse the direction of travel of the door 10. The present invention utilizes the principle of inductance sensing to detect the encountering of an obstruction. It is known that an elongated wire loop has an inductance which is dependent upon the length of the loop, the closeness of the wire in the outbound run of the loop to the return run of the loop, and the proximity of metal objects to the loop.

Figure 2:
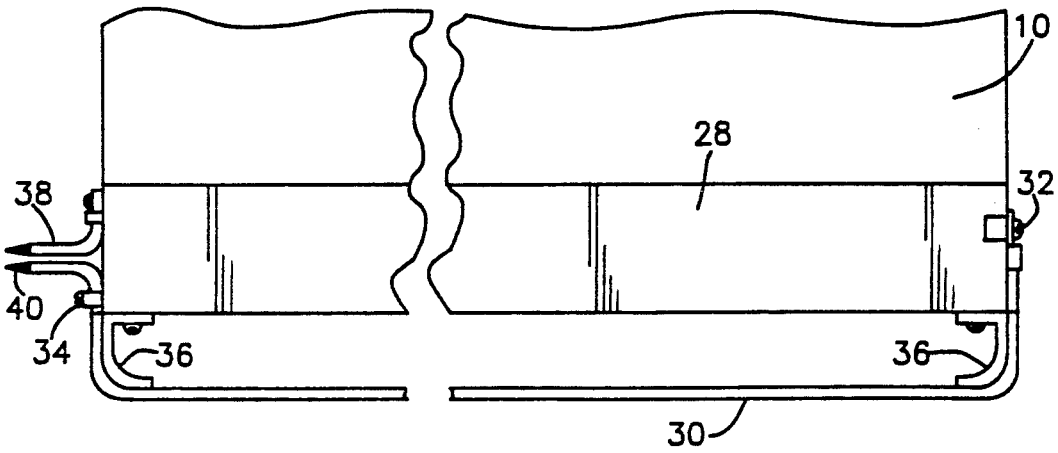
FIG. 2 is an elevational view showing the bottom edge of the door of FIG. 1.

FIG. 2 illustrates a wire sensing loop constructed in accordance with the principles of this invention mounted on the bottom edge of the door for sensing the encountering of obstructions. Thus, the bottom edge of the door 10 is covered with an electrically conductive metal plate 28. The metal plate 28 forms the return run of the sensing loop. The other run of the sensing loop is provided by the elongated electrically conductive metal cable 30, which is covered with a layer of insulating material. The cable 30 is secured at one end, both mechanically and electrically, to the plate 28 by means of the screw 32. The other end of the cable 30 is secured to the door 10 by a clamp 34. Between the screw 32 and the clamp 34, the cable 30 is maintained insulated and spaced from the plate 28 by means of the brackets 36. When installed, the cable 30 is placed under tension so that between the brackets 36 it is substantially straight and parallel to the plate 28. FIG. 2 illustrates the cable 30 as including a single segment, but it is understood that any number of segments may be utilized. Further, in accordance with this invention, instead of cable wire, flat conductive material may also be utilized.

When the door 10 is traveling toward its closed position and strikes an obstruction, the cable 30 is deflected toward the plate 28. This results in a change in the inductance of the loop formed by the plate 28 and the cable 30. However, the change of inductance is very small. For example, if initially the plate 28 and cable 30 are one inch apart and this distance is reduced by 50% to a one half inch separation, the change in inductance is only 0.5%. This change is difficult to detect even when using expensive inductance measuring test equipment. According to the present invention a capacitor is inserted in parallel with the wire sensing loop and the resultant "tank circuit" is driven at its natural resonant frequency. At the resonant frequency of the tank circuit, any change in the inductance of the loop will result in a change in the amplitude of the voltage and current, as well as a phase shift between them. It is this phase shift which is measured and utilized for detecting the encountering of an obstruction. At resonance, the voltage and the current are in phase. This phase relationship is not affected by a change in resistance but a slight change in inductance will cause an easily measurable phase shift. According to this invention, the frequency applied to the loop is varied to keep the voltage and current in phase, so that the tank circuit is always in resonance. As will become clear, this automatically compensates for any variations in installation, and also cancels out any slowly occurring variations, such as aging effects. It is only sudden phase changes which are utilized to signal the encountering of an obstruction.

The plate 28 is electrically coupled to the door operator 12 by the wire 38 and the cable 30 is electrically connected to the door operator 12 by the wire 40. The wires 38 and 40 therefore form part of the sensing loop. Accordingly, if the wires 38, 40 move relative to each other, the system will detect such movement as the encountering of an obstruction. Therefore, the wires 38, 40 must be mechanically joined by twisting or encapsulating them in a molded elastomeric cover, and any stripped lengths outside of the mechanically joined area must not move. Thus, typically, the wires 38, 40 will be held against the edge of the door 10 from the bottom to the top and will extend from the top of the door 10 to the door operator 12. Since the wires 38, 40 are mechanically joined, they can either loosely hang from the door 10 to the door operator 12 or, alternatively, a spring loaded reel can be incorporated in the door operator 12 to take up the slack of the wires 38, 40 as the door 10 is raised. Other arrangements can also be utilized so long as the wires 38, 40 do not move relative each other.

Figure 3:
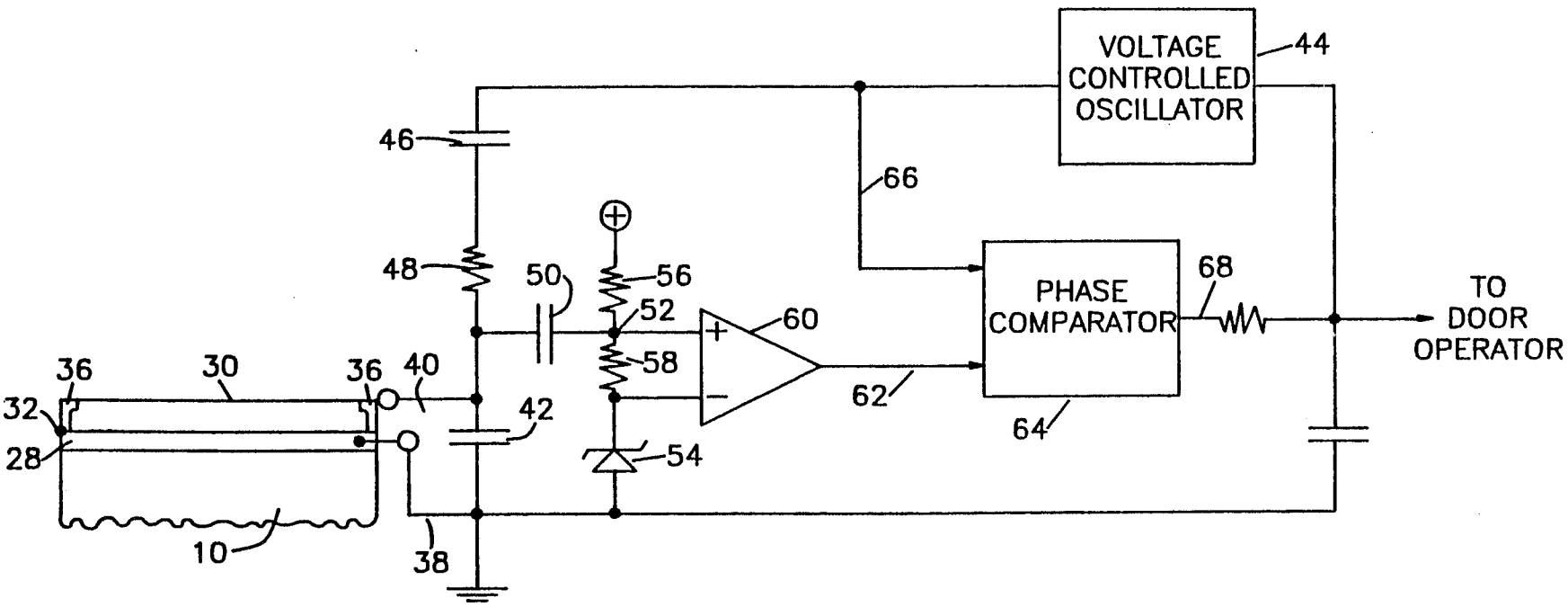
FIG. 3 is a block schematic diagram useful for illustrating the principles of this invention.

FIG. 3 is a block diagram of circuitry connected to the wires 38, 40 and preferably mounted within the housing of the door operator 12 for sensing the encountering of an obstruction by the door 10 and signalling the door operator to take corrective action such as, for example, stopping and reversing movement of the door 10. As shown in FIG. 3, a capacitor 42 is connected in parallel to the loop comprising the wire 40, the cable 30, the metal plate 28, and the wire 38, thereby forming a tank circuit. The voltage controlled oscillator 44 provides an oscillating electrical signal to the tank circuit through the capacitor 46 and the resistor 48. The capacitor 46 enables the current to flow bi-directionally both above and below ground. The value of the resistor 48 is chosen to be at least twenty times the value of the resonant impedance of the tank circuit so that the tank circuit is driven with a constant current. In the preferred embodiment, the voltage controlled oscillator 44 provides a square wave, so the resistor 48 also allows the tank circuit to form a sine wave without fighting the square wave input. The zero crossing point of the current waveform through the tank circuit will be coincident with the rising and falling edges of the input square wave.

The sensing output of the tank circuit is connected through the capacitor 50 to the junction 52 which is referenced to one half the supply voltage by the Zener diode 54. This keeps the sine wave above ground so that it may be amplified. The resistor 56 acts as a pull-up resistor for the Zener diode 54, while the resistor 58 enables the sine wave to form with no clipping effect from the Zener diode 54. This sine wave represents, and is derived from, the voltage across the tank circuit. This voltage is amplified by the amplifier 60 and applied over the lead 62 to the phase comparator 64. The voltage waveform on the lead 62 will not be in phase with the current waveform on the lead 66 except at the resonant frequency of the tank circuit.

When the circuit is first activated, the frequency of the voltage controlled oscillator 44 is low. Therefore, the capacitor 42 is essentially an open circuit and the loop formed by the wire 40, the cable 30, the metal plate 28 and the wire 38 is essentially a short circuited inductive loop. In a purely inductive circuit, the voltage will lead the current by 90° . Therefore, the output of the phase comparator on the lead 68 will be high. This high signal will be applied to the door operator 12 and will cause the door operator to react as if an obstruction is sensed. At the same time, the high signal on the lead 68 will be applied as an input to the voltage controlled oscillator 44, which will increase its output frequency. As the frequency of the signal applied to the tank circuit increases, it approaches the resonant frequency of the tank circuit and the phase difference between the current and voltage will decrease, thereby decreasing the output of the phase comparator 64 and the input to the voltage controlled oscillator 44. Thus, in effect, a servo system is provided for maintaining the tank circuit in resonance. This provides compensation for installation variations, such as the tension on the cable 30, as well as environmental factors. However, when during the operation of the door an obstruction is encountered and the cable 30 is moved toward the door 28, the tank circuit will lose resonance and a signal will be generated on the lead 68. Illustratively, the circuitry is preset to detect a 50% change in the distance from the cable 30 to the metal plate 28. For example, if the cable is one half inch away from the bottom of the door 10, then one quarter inch of movement will result in the sensing of an obstruction. Time is also a factor in the generation an obstruction signal. The movement of the cable 30 by 50% of its distance from the metal plate 28 must occur within a one half second time period, or else the servo system will consider it just a change in cable tension or position and will adjust the resonant frequency accordingly.

Figure 4:
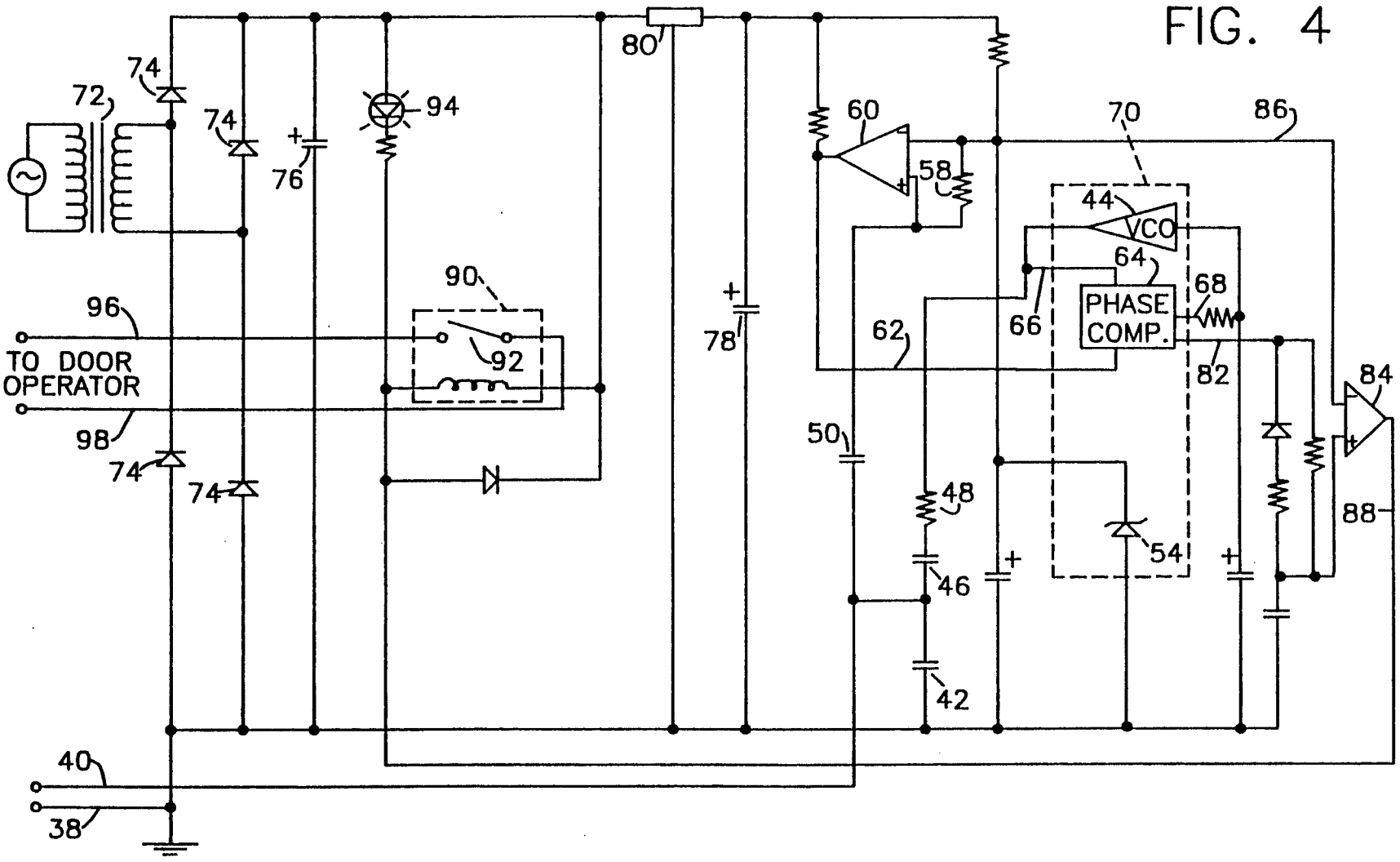
FIG. 4 is a detailed electrical schematic diagram of illustrative circuitry operating in accordance with the principles of this invention.

FIG. 4 shows illustrative circuitry for implementing the block diagram of FIG. 3. In a preferred embodiment, the voltage controlled oscillator 44, the phase comparator 64, and the Zener diode 54 are all part of a phase locked loop integrated circuit 70. The circuitry shown in FIG. 4 is powered through a transformer 72 whose output is full wave rectified by the diodes 74 and then regulated and filtered by the capacitor 76, the capacitor 78, and the varistor 80. The operation of the circuitry shown in FIG. 4 is essentially the same as that described above with regard to FIG. 3. As shown in FIG. 4, the output of the phase comparator 64 on the lead 82 is applied to circuitry including the comparator 84 which compares the output on the lead 82 with a reference voltage on the lead 86 determined by the Zener diode 54. The output of the phase comparator 64 on the lead 82 is complemental to the output of the phase comparator 64 on the lead 68, which goes to the voltage controlled oscillator 44. Accordingly, when the output on the lead 82 goes below the reference voltage on the lead 86, this indicates the encountering of an obstruction by the door 10 and the output of the comparator 84 on the lead 88 goes low. The low signal on the lead 88 is applied to one side of the coil of the reed relay 90, the other side of which is connected to the positive voltage supply. Accordingly, the reed relay 90 is energized and its contact 92 closes a path between the leads 96 and 98 which go to the door operator 12. This signals the door operator 12 that an obstruction has been encountered. At the same time, the low signal on the lead 88 causes energization of the light emitting diode 94, which provides a visual indication that an obstruction has been encountered and sensed.

As described above, this circuitry automatically compensates if the cable 30 should gradually sag, change tension, or change position. Closing the door 10 so that the cable 30 is pressed closer to the metal plate 28 will cause an obstruction signal to be generated but within a few seconds the circuitry will automatically recompensate and go back to normal operation. (It should be noted that conventional door operators ignore obstruction sensing when the door is fully closed or within two inches of closure.) When the door 10 is wide and cable 30 is relatively long, vibration of the cable must be maintained below 50% of the distance from the cable 30 to the plate 38. This can be accomplished by increasing the cable tension, by adding standoff blocks between the brackets 36, or the cable 30 can be attached to rubber molding used to seal the door 10 to the floor 26.

As material for the cable 30, any conductive material with a total resistance of three ohms or less can be used. Corrosion, wear or change in the position of the cable 30 gradually over time will not affect the electrical properties of this system due to its automatic and continuous readjustment feature. Metal plates, metal foil or metal screening can also be used. Any thickness and width can be used, but flexibility must be considered.

Accordingly, there has been disclosed an improved safety arrangement for an automatic door operator which is sensitive to the door striking an obstruction while being closed. While a preferred embodiment of the present invention has been disclosed herein, it is understood that various modifications and adaptations to the disclosed arrangement will be apparent to those of ordinary skill in the art and it is only intended that this invention be limited by the scope of the appended claims.

I claim:

1. A safety arrangement for a motor driven door, said door having an edge which is driven along a path toward and away from a fixed surface, the safety arrangement being effective for detecting an obstruction in said path, the arrangement comprising:

a first electrically conductive member fixedly secured to said edge;

an elongated flexible second electrically conductive member connected at one end to said first conductive member, said second conductive member being supported from said one end to its other end spaced and insulated from said first conductive member;

a capacitor connected between said other end of said second conductive member and a point on said first conductive member remote from where said one end of said second conductive member is connected to said first conductive member so as to form a loop;

controllable oscillator means for providing an oscillating electrical signal at a frequency which may be controllably varied;

means for applying said oscillating signal to said loop;

means for comparing the phase of the voltage across said capacitor to the phase of the current of said oscillating signal and providing an output signal at a voltage level indicative of the phase difference between said voltage and said current;

means for utilizing said output signal to control said oscillator means to vary the frequency of said oscillating signal so as to minimize the voltage level of said output signal; and safety means utilizing said output signal for controlling movement of said door;

whereby when the door edge encounters an obstruction the second conductive member is moved closer to the first conductive member so that the inductance of the loop is suddenly changed, thereby suddenly changing the resonant frequency of the loop and increasing the magnitude of the output signal voltage.

2. The arrangement according to claim 1 wherein said first conductive member comprises a metal plate covering said door edge.

3. The arrangement according to claim 1 wherein said second conductive member comprises a metal wire.

4. The arrangement according to claim 3 wherein said metal wire is maintained under tension.

5. The arrangement according to claim 1 wherein said safety means includes means for comparing said output signal to a reference voltage and providing an obstruction signal in response to a predetermined relation between said output signal and said reference voltage.

6. The arrangement according to claim 5 wherein said safety means includes a relay and means responsive to the occurrence of said obstruction signal for energizing said relay.

7. The arrangement according to claim 5 wherein said safety means includes visual indicating means and means responsive to the occurrence of said obstruction signal for energizing said visual indicating means.

8. The arrangement according to claim 1 wherein said controllable oscillator means and said phase comparing means are part of a phase locked loop integrated circuit.

9. A safety arrangement for a motor driven door, said door having an edge which is driven along a path toward and away from a fixed surface, the safety arrangement being effective for detecting an obstruction in said path, the arrangement comprising:

means for providing an inductance on said door edge which changes upon striking an obstruction;

means for connecting said inductance in a tank circuit with a capacitor;

means for electrically driving said tank circuit at its resonant frequency;

means for measuring the phase difference between the voltage and the current from said driving means; and means responsive to a sudden change in the measured phase difference for generating an obstruction signal.

10. The arrangement according to claim 9 wherein said inductance comprises:

an electrically conductive plate covering said door edge; and an elongated electrically conductive member supported substantially parallel to and spaced from said metal plate and electrically connected at one end to said metal plate.

11. The arrangement according to claim 10 wherein said elongated member comprises a metal wire.

12. The arrangement according to claim 11 wherein said wire is maintained under tension.

13. The arrangement according to claim 9 wherein said driving means includes servo means for maintaining said tank circuit in resonance, said servo means being so arranged that gradual changes in said inductance are compensated for without the generation of said obstruction signal.

* * * * *